US010920974B2

(12) United States Patent
Chen et al.

(10) Patent No.: US 10,920,974 B2
(45) Date of Patent: Feb. 16, 2021

(54) INTELLIGENTLY-CONNECTED VEHICLE LED HEADLIGHT USING GRAPHENE

(71) Applicants: HUZHOU MINGSHUO OPTOELECTRONIC TECHNOLOGY CO., LTD., Zhejiang (CN); TUNGHSU OPTOELECTRONIC TECHNOLOGY CO., LTD., Hebei (CN)

(72) Inventors: Wei Chen, Zhejiang (CN); Wei Jiang, Zhejiang (CN); LiBin Zhou, Zhejiang (CN)

(73) Assignees: HUZHOU MINGSHUO OPTOELECTRONICS TECHNOLOGY CO., LTD., Zhejiang (CN); TUNGHSU OPTOELECTRONIC TECHNOLOGY CO., LTD., Hebei (CN)

( * ) Notice: Subject to any disclaimer, the term of this patent is extended or adjusted under 35 U.S.C. 154(b) by 0 days.

(21) Appl. No.: 16/633,901

(22) PCT Filed: Jul. 27, 2018

(86) PCT No.: PCT/CN2018/097392
§ 371 (c)(1),
(2) Date: Jan. 24, 2020

(87) PCT Pub. No.: WO2019/020105
PCT Pub. Date: Jan. 31, 2019

(65) Prior Publication Data

US 2020/0224866 A1 Jul. 16, 2020

(30) Foreign Application Priority Data

Jul. 27, 2017 (CN) ..... 201710626780.4

(51) Int. Cl.
*F21V 29/85* (2015.01)
*F21V 29/51* (2015.01)
(Continued)

(52) U.S. Cl.
CPC ..... *F21V 29/85* (2015.01); *F21S 41/141* (2018.01); *F21S 41/275* (2018.01); *F21V 29/51* (2015.01); *F21Y 2115/10* (2016.08)

(58) Field of Classification Search
None
See application file for complete search history.

(56) References Cited

U.S. PATENT DOCUMENTS 9,033,563 B1 * 5/2015 Hsu ..... F21S 41/255 362/547
2006/0076572 A1 * 4/2006 Huber ..... F21S 45/60 257/99

(Continued)

FOREIGN PATENT DOCUMENTS

CN 201885119 6/2011
CN 102634212 8/2012

(Continued)

OTHER PUBLICATIONS

International Search Report dated Sep. 27, 2018 in International (PCT) Application No. PCT/CN2018/097392.

*Primary Examiner* — Ashok Patel
(74) *Attorney, Agent, or Firm* — Wenderoth, Lind & Ponack, L.L.P.

(57) ABSTRACT

Provided is an intelligently-connected vehicle LED headlight using graphene, which comprises an imaging lens assembly (9, 5, 6, 7), an LED light source (1), and a heat dissipation assembly (2, 3, 4), wherein the imaging lens assembly (9, 5, 6, 7) is connected to the LED light source (1), and the LED source (1) is connected to the heat dissipation assembly (2, 3, 4). The light distribution manner (Continued)

of the light source of the vehicle headlight is changed from emitting light by a reflector to emitting light by imaging, so that the light emission efficiency is improved by more than 30%. Further, a graphene heat dissipation material is used in the vehicle headlight to dissipate heat, and accordingly the heat dissipation capability of the lamp can be better improved, thereby prolonging the service life of the vehicle headlight.

12 Claims, 4 Drawing Sheets

(51) Int. Cl.

| | |
|---|---|
| ***F21S 41/275*** | (2018.01) |
| ***F21S 41/141*** | (2018.01) |
| ***F21Y 115/10*** | (2016.01) |

(56) References Cited

U.S. PATENT DOCUMENTS

| | | | | |
|---|---|---|---|---|
| 2013/0107552 | A1* | 5/2013 | Ahn | F21S 41/635 362/465 |
| 2014/0029287 | A1 | 1/2014 | Anzai et al. | |
| 2014/0063829 | A1 | 3/2014 | Kushalappa et al. | |
| 2015/0308649 | A1* | 10/2015 | Chen | F21S 41/255 362/516 |
| 2017/0167712 | A1* | 6/2017 | Melzner | F21V 29/59 |

FOREIGN PATENT DOCUMENTS

| | | |
|---|---|---|
| CN | 103131274 | 6/2013 |
| CN | 104251387 | 12/2014 |
| CN | 104726069 | 6/2015 |
| CN | 105514059 | 4/2016 |
| CN | 106287256 | 1/2017 |
| CN | 206207023 | 5/2017 |
| CN | 106939988 | 7/2017 |
| CN | 107246579 | 10/2017 |
| CN | 206904868 | 1/2018 |
| JP | 2005-106974 | 4/2005 |
| JP | 2006-164967 | 6/2006 |
| JP | 2014-26741 | 2/2014 |
| JP | 2015-530712 | 10/2015 |
| JP | 2016-31158 | 3/2016 |
| KR | 10-2017-0022754 | 3/2017 |

* cited by examiner

INTELLIGENTLY-CONNECTED VEHICLE LED HEADLIGHT USING GRAPHENE

FIELD OF THE INVENTION

The invention relates to the technical field of automotive vehicle fittings, and particularly relates to an intelligently-connected vehicle LED headlight using graphene.

BACKGROUND OF THE INVENTION

The development of automotive headlight technology has experienced the era of kerosene headlights, acetylene headlights, halogen headlights, xenon headlights, and LED headlights. With the increasing requirements for automotive vehicle safety and lighting stability in recent years, the popularization of social concepts of energy saving and emission reduction, and the requirements for improved automotive vehicle appearance quality, high-power light-emitting diodes (LEDs) with the advantages including short start-up time, long service life, high efficiency light and easy integration have gradually shown great potential in the field of automotive lighting. LED lights have replaced traditional halogen lights as the most commonly used lamps in the field of automotive lighting.

Automotive lighting mainly comprises automotive illumination lights (headlights, fog lights, license plate lights, instrument lights, ceiling lights, work lights, etc.) and automotive signal lights (turn lights, warning lights, width lights, tail lights, brake lights, reversing lights, etc.). LEDs are widely used as signal lights (position lights, brake lights, turn signals, daytime running lights). As the needs in this industry are increasingly updated, the problem of LEDs as functional lighting sources for automotive lighting such as front fog lights, high beam and low beam lights (automotive headlights) and the like needs to be solved urgently. In the case that general lighting has been turned into a "Red Sea" of the price war, LED automotive lighting has become a hot "Blue Ocean market". According to the estimate of Yole Developpement, the global automotive lighting market is expected to reach a market size of 27.7 billion US dollars by 2021 with a compound annual growth rate (CAGR) of 23.7%.

Internationally renowned manufacturers such as Osram, Toyota Gosei, Koito, Lumileds, and Cree started research and development of automotive LEDs as early as the 1990s. In recent years, they have invested heavily in research and development to form a complete production system of a series of products of automotive LED light source, especially the development of multi-chip integrated LED light source products specifically used for high beam and low beam of the headlights, thereby maintaining technological leadership in terms of light efficiency, thermal resistance, temperature resistance, antistatic and product consistency. Relying on their strong technical strength, they extend technical services in applied products, have basic data to provide ray-tracing of light distribution optical design for LED light source of headlight, and have reached a high level in providing LED optics, heat dissipation, and driving solutions.

In recent years, the output value of automotive headlights has increased year by year, reaching 2.7 billion Yuan in 2015, and 3.5 billion Yuan in 2016. So far, the output value of 2017 has reached 4 billion Yuan with a rapid growth. From the proportion of various headlight types of automotive vehicles, currently the LED headlights account for only 5%. However, due to LED lights are of green, environmentally friendly and energy saving, it is expected that LED type headlights will account for more than 20% of the headlight market.

At present, LED lights are rapidly infiltrating into the automotive headlight market, mainly in two directions: 1. an automotive factory-installed market, that is the automotive vehicle is installed with automotive vehicle LED headlight assembly before the automotive vehicle leaves the factory; 2. an automotive aftermarket-installed market, that is a refit market, removing the original halogen bulbs, xenon headlight bulbs, and replacing them with automotive vehicle LED headlights.

Due to the very high requirements of automotive factory-installed LED headlight assembly, generally only manufacturers with technical research and development capabilities conduct design, production and sales, while the automotive aftermarket-installed market has not yet formed a perfect management system and the technology platform is low, so in China more than 96% of LED light manufacturing enterprises have flooded into the LED headlamp aftermarket-installed market, and the products with uneven quality are mixed up.

At present, an LED light source module for aftermarket-installed vehicles comprises one or more LED chips, mechanical and optical assemblies, drive modules, connectors, radiators, etc., and it has a high degree of integration.

Mostly an aftermarket-installed vehicle LED headlight on the market mainly comprises a reflector a, an LED light source b, a radiator c, a fan d, a solenoid valve baffle e, and a light distribution lens f, as shown in FIG. 1.

There are many disadvantages in the use of this type of headlights, for example, 1. short life, due to the active cooling by fan, once the fan fails, the LEDs will quickly die; 2. low light emission efficiency, the LEDs of this type of lights are placed horizontally due to high requirement of lateral heat dissipation, so that the light distribution manner can only be reflective light collection+baffle, resulting in low light emission efficiency, which is only about 40% on average, as shown in FIG. 2; 3. large light decay, due to the insufficient heat dissipation capacity and low light emission efficiency of this type of lights, the required luminous flux can only be achieved by increasing power, when the LED is working at high load, the heat generation increases sharply, and the aging speed of phosphor is accelerated, thereby resulting in a large light decay.

CONTENTS OF THE INVENTION

In order to overcome the above technical problems, the present invention provides an intelligently-connected vehicle LED headlight using graphene, which changes the structure of the vehicle LED headlight, and then changes the light distribution manner of the light source, i.e., the light distribution manner of the light source is changed from emitting light by a reflector to emitting light by imaging, then the light emission efficiency is increased by more than 30%. Further, graphene heat dissipation material is used in this kind of headlights for heat dissipation, and the heat dissipation capacity of the light is improved, thereby increasing the service life of the vehicle headlight.

Based on this, the present invention provides an intelligently-connected vehicle LED headlight using graphene, the vehicle LED headlight comprises an imaging lens assembly, an LED light source and a heat dissipation assembly, wherein the imaging lens assembly is connected to the LED light source, and the LED light source is connected to the heat dissipation assembly, and wherein the heat generated by the LED light source is dissipated by the heat dissipation assembly, and the light of the LED light source is changed by the imaging lens assembly, the imaging lens assembly enables the light emission manner to be a way of horizontally emitting light by imaging.

The intelligently-connected vehicle LED headlight using graphene has no reflector assembly.

The heat dissipation assembly comprises a super-heat-conducting vapor chamber, a radiator, and a graphene heat-conducting glue.

The graphene heat-conducting glue is connected to the super-heat-conducting vapor chamber, and the graphene heat-conducting glue is adhered to the LED light source.

The working liquid in the super-heat-conducting vapor chamber is a graphene phase change composite material.

An outer surface of the radiator is coated with a graphene heat dissipation material.

The imaging lens assembly comprises a fluorescent ceramic, a primary light distribution lens, a light mixer, and a secondary light distribution lens.

The fluorescent ceramic is provided in front of the LED light source, the light mixer is provided closely adjacent to the fluorescent ceramic, and the primary light distribution lens is provided closely adjacent to the light mixer.

Beneficial Technical Effects

The intelligently-connected vehicle LED headlight using graphene provided herein changes the structure of the vehicle LED headlight, and further changes the light distribution manner of the light source. The light distribution manner of the light source is changed from emitting light by a reflector to emitting light by imaging, then the light emission efficiency is increased by more than 30%. Further, graphene heat dissipation material in this kind of headlights is used for heat dissipation, and the heat dissipation capacity of the light is improved, thereby increasing the service life of the vehicle headlight.

DETAIL DESCRIPTION OF SPECIFIC EMBODIMENTS

Figure 1:
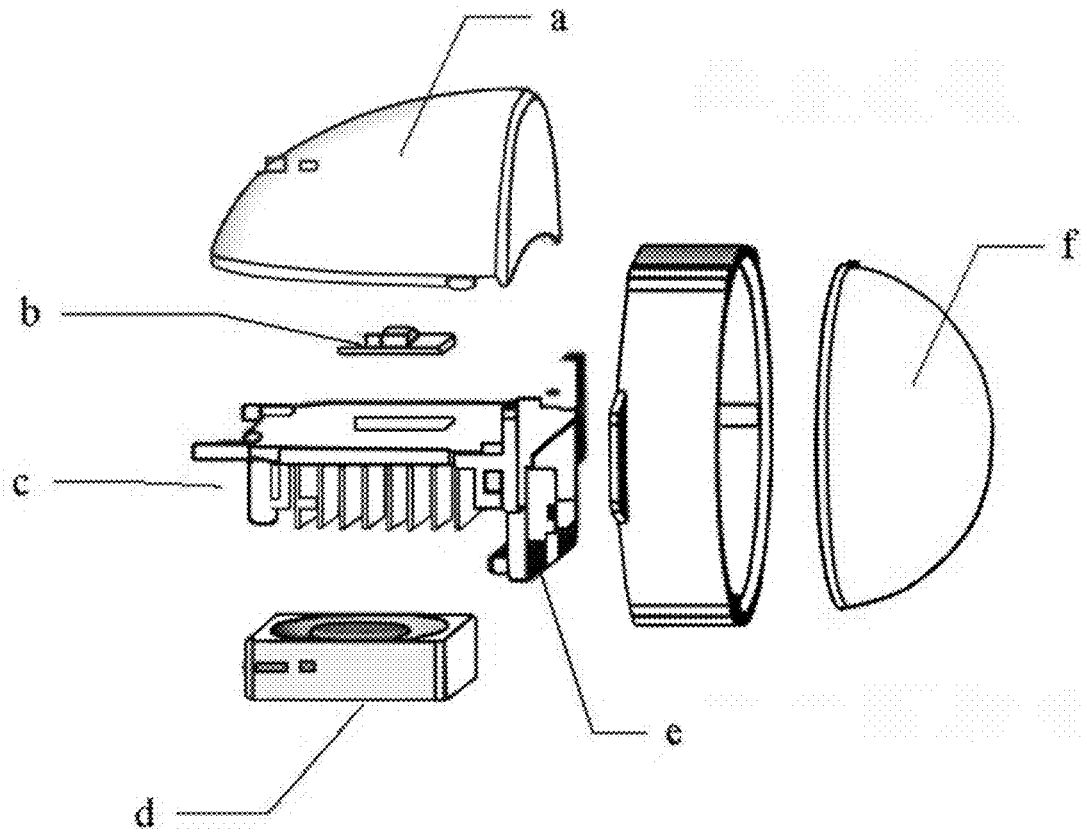
FIG. 1 is a schematic structural diagram of an existing vehicle headlight.
Figure 2:
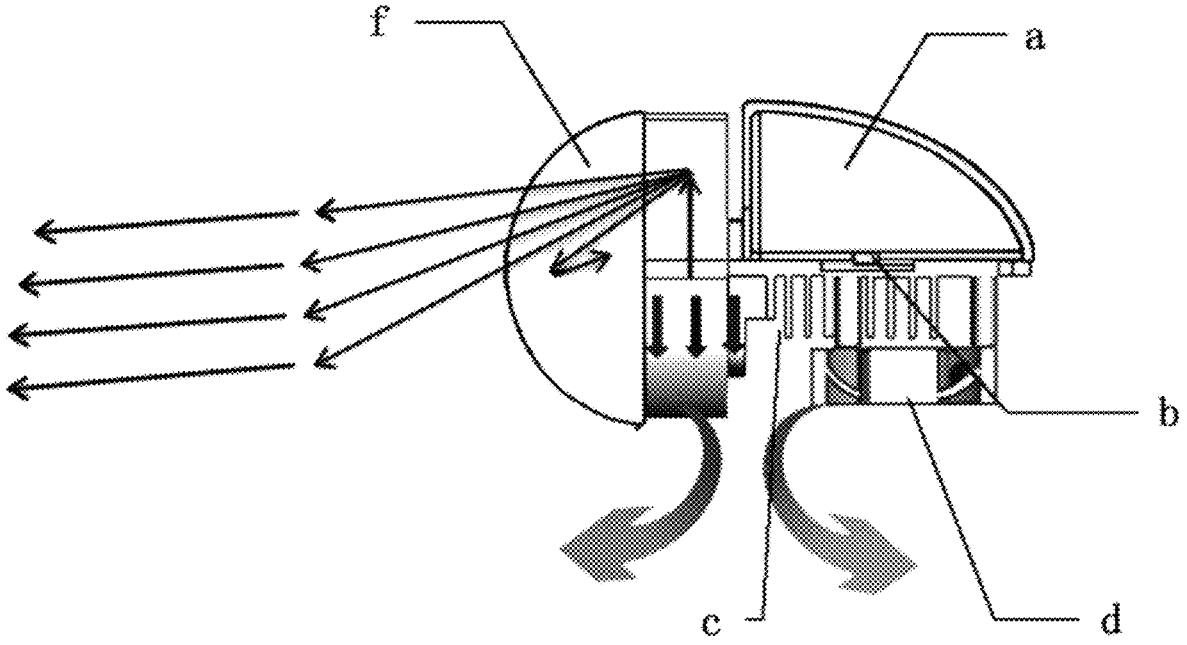
FIG. 2 is a light mode of an existing vehicle headlight.

The vehicle LED headlight provided herein comprises an imaging lens assembly, an LED light source, a super-heat-conducting vapor chamber, a radiator, and a graphene heat-conducting glue. With the proposal of the super heat dissipation performance of graphene materials, the present invention attempts to change the structure of LED headlights, and then change the light distribution manner of its light source, i.e., the light distribution manner of the light source is changed from emitting light by a reflector to emitting light by imaging, then the light emission efficiency is increased by more than 30%.

Compared with the traditional vehicle LED headlights, the vehicle LED headlights provided herein abandon the reflector, but adopt a light emission manner of directly and horizontally emitting light by imaging so as to maximize the light emission efficiency.

The imaging lens assembly is composed of a fluorescent ceramic, a primary light distribution lens, a light mixer, and a secondary light distribution lens. The fluorescent ceramic is provided in front of the LED light source, and is responsible for illuminating the blue light of the LED light source onto the ceramic phosphor to be converted into white light. The fluorescent ceramic has no light decay under high temperature environment. The light mixer is provided closely adjacent to the fluorescent ceramic, and it is responsible for mixing the light emitted by the LED light source evenly, and further improving the quality of the light. One surface of the light mixer has a slightly orange peel structure with a reflective coating, and an antireflection coating is applied respectively on both ends. The light is emitted from the front end of the light mixer after further improving the uniform light mixing, the front end of the light mixer is provided with a cut-off line. There are two light mixers, one for the high beam and one for the low beam. The primary light distribution lens is provided closely adjacent to the light mixer, and it collects light to improve light emission efficiency, and adopts a high refractive index material. The secondary light distribution lens achieves an imaging effect by using a material different from that of the primary light distribution lens.

The imaging lens assembly is connected to the LED light source, keeping the light emitted by the LED light source as horizontal light and relatively concentrated, then the light will not be scattered. Compared to the traditional vehicle LED headlight with a reflector, the imaging lens assembly changes the manner of light distribution and light emission to avoid the reduction of light emission efficiency caused by the reflection path of the reflector. This level of light emission improves the light efficiency by 30%.

Due to the relatively small overall volume of the automotive vehicle headlight, the internal space is relatively compressed, and the heat can only be taken away by the air convection brought by a fan. The problems with the use of a fan are: 1. Once the fan runs poorly or is damaged, the heat continues to accumulate, and the internal temperature will rise, causing the light source to dim or directly causing a "dead light" phenomenon; 2. The installation of a fan has increased a part of the energy consumption, and the matching external member of the fan, such as an external member for fixing the fan, not only increase the volume but also increase the overall weight accordingly. In view of this problem, the present invention abandons the use of a fan and replaces it with a graphene-containing vapor chamber and a radiator.

In the present invention, the LED light source and the graphene heat-conducting glue are adhered together. The graphene heat-conducting glue has a high thermal-conductivity coefficient, and thereby can better realize the heat conduction of the LED light source, and the graphene heat-conducting glue has a lifespan that is 4 times longer than that of the traditional silicone grease.

The graphene heat-conducting glue may be any type of commercially available heat-conducting glue prepared by graphene, and the graphene heat-conducting glue mentioned in the applicant's earlier application CN201210119361.9 may be preferably used, and the details are not described herein again.

The graphene heat-conducting glue is bonded to a super-heat-conducting vapor chamber, which can increase the hot-melt density and delay the temperature rise.

The inside of the super-heat-conducting vapor chamber is a hollow structure, which is mainly composed of a bottom plate (evaporation area) and an upper cover (condensation area). There is a hollow between the bottom plate and the upper cover. The inside of the bottom plate and the upper cover have a capillary structure, the capillary structure is used to provide the capillary force for the liquid backflow, and is used to provide backflow of the liquid from the condensation area to the evaporation area. The vapor chamber also has a small amount of working liquid in the evaporation area.

The low vacuum in the container makes the working substance (working liquid) boiling very easily. The way it works is that the working fluid in the closed container quickly turns into steam after absorbing heat, and the steam pressure drives the steam to the condensation area. The heat is transferred by using the phase change latent heat of the working substance, i.e., when the steam meets external condensation, it releases heat and turns into a liquid, and the liquid is returned to the evaporation area through the capillary structure, so that the cycle of the entire heat exchange process is resumed.

The material of the container for the super-heat-conducting vapor chamber is mainly oxygen-free copper C1020. The liquid working substance can be graphene phase change composite material, water, methanol, acetone, paraffin, and any other materials that can conduct heat, preferably, the graphene phase change composite material. Any graphene phase change composite material on the market may be used, it is preferably to use the graphene composite phase change material disclosed in Chinese patent application CN201310714156.1 which was filed early by the applicants of the present application, and the details are not described herein again. This material is a heat storage material, and this graphene phase change material is poured into the vapor chamber. This is a phase change composite material with solid-liquid and liquid-solid physical transformation. In this physical change process, hot melt is increased to realize latent heat storage, so that the light source is within an expected temperature range, the functionality of a fan is surpassed by cooperating with a graphene radiator which is also one of our alternative structures to eliminate the fan. The self-protection of the light source chip due to the influence of temperature is minimized, autonomously reducing the working current, and thereby reducing the brightness. Even the direct "dead lamp" ensures that the light source can stably and continuously emit light, thereby making the light after imaging more stable.

The capillary structure can be obtained by sintering copper powder or sintering a copper wire mesh. The shape of the super-heat-conducting vapor chamber can be flat or three-dimensional.

The LED light source, the graphene heat-conducting glue, and the super-heat-conducting vapor chamber are provided inside the radiator housing. The heat generated by the light source is transmitted to the radiator, and the heat of the vehicle LED headlight is dissipated through the radiator.

A graphene coating is applied on the outer surface of the radiator. The graphene coating can increase the heat emissivity and improve the heat dissipation effect. Furthermore, the outer surface of the radiator is sprayed with graphene by frost spraying to increase the heat dissipation area. The graphene coating may be any graphene material coating, it is preferable to use the RLCP graphene fluororesin composite material coating disclosed in Chinese patent application CN201310089504.0 which was filed early by the applicant of the present application, and the details are not described herein again.

Compared with the traditional vehicle LED light with a reflector, through the way of light distribution by imaging the light emission efficiency of the vehicle LED headlight according to the present invention reaches 85%. For the traditional vehicle headlight with reflector, the light source first passes through the "secondary medium", a reflector, and then is transmitted after the light source is integrated; it is difficult to ensure the surface flatness of the reflector, and the diffused reflection after the second integration is severe, causing uneven light and severe reflection of light, and causing a certain amount of light pollution to pedestrians or other vehicles, and the light emission is more uniform through a way of light distribution by imaging, and the light pollution is little.

The embodiments of the present invention will be described in detail below with reference to the following Examples and the accompanying drawings, so as to fully understand and carry out the implementation process of how to use the technical means to solve technical problems and achieve the corresponding technical effects in the present invention.

EXAMPLE

Example 1

Figure 3:
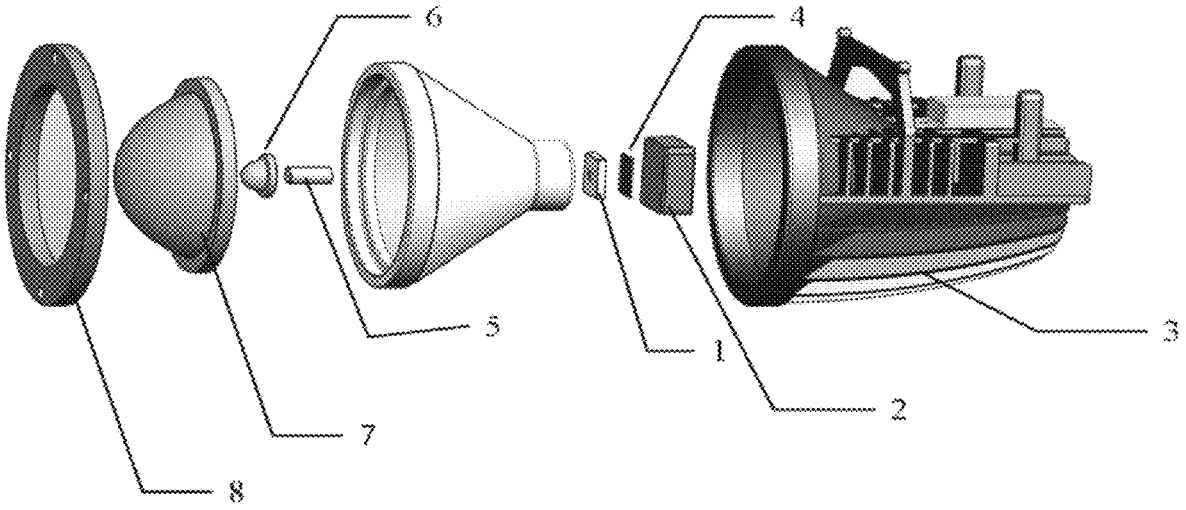
FIG. 3 is a schematic structural diagram of an intelligently-connected vehicle LED headlight using graphene according to the present invention.

As shown in FIG. 3, the intelligently-connected vehicle LED headlight using graphene provided herein comprises an imaging lens assembly, an LED light source 1 and a heat dissipation assembly, wherein the heat dissipation assembly comprises a super-heat-conducting vapor chamber 2, a radiator 3, and a graphene heat-conducting glue 4, the imaging lens assembly is connected to the LED light source 1, and the LED light source 1 is adhered with the graphene heat-conducting glue 4, the graphene heat-conducting glue 4 is from the content disclosed in Chinese patent application CN201210119361.9, the graphene heat-conducting glue 4 is connected to the super-heat-conducting vapor chamber 2 made of graphene material, the super-heat-conducting vapor chamber 2 can increase the hot melt density and delay the temperature rise.

The inside of the super-heat-conducting vapor chamber is a hollow structure, which comprises a bottom plate (evaporation area) and an upper cover (condensation area). The bottom plate and the upper cover are aluminum plates or aluminum alloy plates. There is a hollow space between the bottom plate and the upper cover, and there are numerous capillary structures between the bottom plate and the upper cover. The capillary structures are used to provide the capillary force leading to liquid backflow, and used to provide a flow of liquid backflow from the condensation area to the evaporation area. There is also a small amount of working liquid in the vapor chamber, and the working liquid is in the evaporation area. The graphene phase change composite material disclosed in Chinese patent application CN201310714156.1 is used as the working liquid. The following additive ingredients are used and the mass ratio of carbon nanotubes, graphene, particles, and fumed silica is 1:10:8:1, and the mass ratio of the whole additive to the phase change material is 1:4, wherein the purity of the carbon nanotubes is ≥95 wt %, the ash content is ≤0.2 wt %, the particles are alumina ($Al_2O_3$) and the average particle diameter is 10 μm, the phase change material is paraffin, and the phase change temperature is 70° C. Preparation method:

the paraffin is heated to be completely melted, and then carbon nanotubes, graphene and particles with a mass ratio of 1:10:8 are poured into the paraffin melt to perform premixing, then the mixture is stirred until well mixed, and the fumed silica with required mass is slowly added, stirring until well mixed, and then the mixture is cooled to obtain the final new phase change material.

Figure 4:
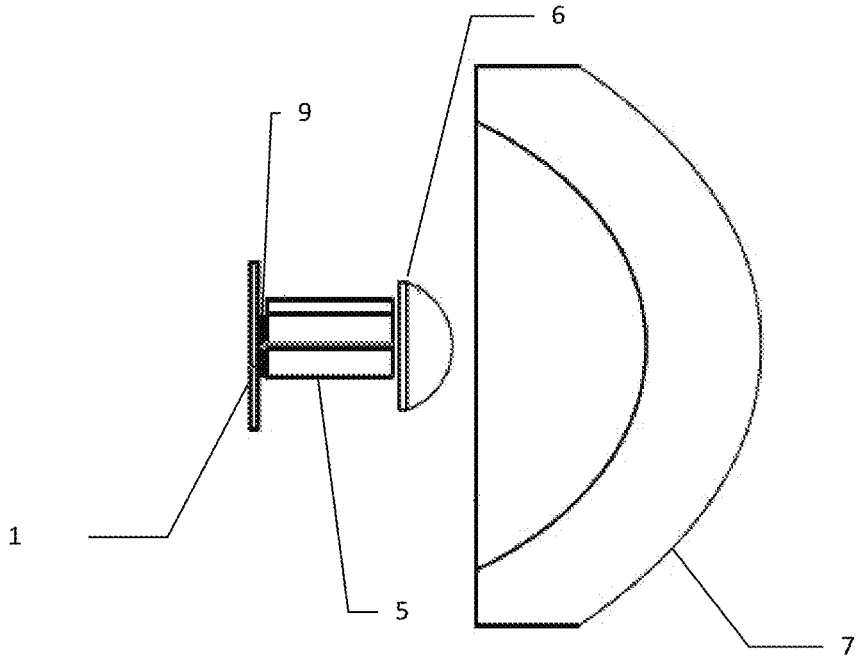
FIG. 4 is a schematic structural diagram of an imaging lens assembly of an intelligently-connected vehicle LED headlight using graphene according to the present invention.

The LED light source 1, the graphene heat-conducting glue 4, and the super-heat-conducting vapor chamber 2 made of the graphene material are provided inside the housing of the radiator 3, and the heat generated by the light source is transmitted to the radiator, and the heat dissipation of the vehicle LED headlight is realized through a radiator. A graphene coating is applied on the outer surface of the radiator 3, and the graphene coating is an RLCP graphene fluororesin composite coating disclosed in Chinese patent application As shown in FIGS. 3 and 4, the imaging lens assembly comprises a fluorescent transparent ceramic 9, a light mixer 5, a primary light distribution lens 6, and a secondary light distribution lens 7. The fluorescent transparent ceramic 9 is provided in front of the LED light source 1, which is responsible for converting the blue light of the LED light source 1 into white light, and the fluorescent transparent ceramic 9 has no light decay under high temperature environment. The light mixer 5 is provided closely adjacent to the fluorescent ceramic, and it is responsible for uniformly mixing the light emitted from the LED light source, and further improving the quality of the light. One surface of the light mixer 5 has a slightly orange peel structure with a reflective coating, and an antireflection coating is applied respectively on both ends. The light is emitted from the front end of the light mixer after further improving the uniform light mixing, the front end of the light mixer is provided with a cut-off line. There are two light mixers, one for the high beam and one for the low beam. The primary light distribution lens 6 is provided closely adjacent to the light mixer, and it collects light to improve light emission efficiency, and adopts a high refractive index material. The secondary light distribution lens 7 achieves an imaging effect by using a material different from that of the primary light distribution lens. A lens pressing ring 8 is provided outside the secondary light distribution lens.

The intelligently-connected vehicle LED headlight using graphene provided herein adopts a multi-channel graphene heat dissipation technology, which guarantees a normal working life of 30,000 hours, while the traditional halogen lamp only has a working life of 500 hours.

Example 2

The difference between the intelligently-connected vehicle LED headlight using graphene in this example and that in the Example 1 only lies in that: the vehicle LED headlight of this example does not contain the graphene heat-conducting glue 4, and the LED light source 1 directly adheres to the super-heat-conducting vapor chamber.

Example 3

The difference between the intelligently-connected vehicle LED headlight using graphene in this example and that in the Example 1 only lies in that: the vehicle LED headlight of this example does not comprise a super-heat-conducting vapor chamber 2.

The color temperature was measured by a spectrum analyzer (Niton, US), the luminous flux was measured by a distribution photometer (Hongpu, Hangzhou), and the power consumption was measured by an electric meter.

In order to verify the effect of the intelligently-connected vehicle LED light using graphene according to the present invention, 400 sets of experimental products are provided, which are halogen vehicle lights, xenon vehicle lights, ordinary vehicle LED lights and intelligently-connected vehicle LED lights using graphene provided herein. Under the condition of controlling the same use environment, lighting for 10 hours, the data results are obtained and shown in Table 1.

TABLE 1

Experimental comparison

| Type | Normal rated power | Color temperature | Luminous flux | Light efficiency | Power consumption | Fractional energy saving |
|---|---|---|---|---|---|---|
| Halogen vehicle lights | 110 W | 3200 K | 900 LM | 8.2 LM/W | 1.1 KWH | 0% |
| Xenon vehicle lights | 45 W | 4200 K | 1500 LM | 33 LM/W | 0.45 KWH | 59% |
| Ordinary vehicle LED lights | 42 W | 3000 K-6500 K | 1500 LM | 36 LM/W | 0.42 KWH | 62% |
| Example 1 | 21 W | 3000 K-6500 K | 1500 LM | 72 LM/W | 0.21 KWH | 81% |
| Example 2 | 21 W | 3000 K-6500 K | 1200 LM | 60 LM/W | 0.21 KWH | 81% |
| Example 3 | 21 W | 3000 K-6500 K | 1100 LM | 55 LM/W | 0.21 KWH | 81% |

As can be seen from the data, the power of the intelligently-connected vehicle LED lights using graphene provided herein is half or even more than half lower than that of other vehicle lights. However, in terms of luminous flux and light efficiency, vehicle LED lights according to the invention can completely replace or even exceed other vehicle lights, and its energy consumption has been reduced accordingly.

With the same luminous flux, the vehicle lights using graphene provide herein can be made with a lower power, the impact on the light temperature is lower, thus the life of the light is longer, and the energy consumption of the light is relatively reduced. That is to say, the low power of the vehicle LED lights according to the invention can produce the same effect as other lamps with high power, or even better. It shows that the improved vehicle light is more energy-saving, safer, and has a longer life.

All of the above mentioned primary implementations of this intellectual property do not set restrictions on other forms of implementation of this new product and/or new method. Those skilled in the art will use this important information and modify the above described to achieve a similar implementation. However, all modifications or alterations based on the new product of this invention are reserved.

Only the preferred embodiments of the present invention are described above, and they are not intended to limit the present invention in other forms. As for any person skilled in the art, technical content disclosed herein may be modified or changed into equivalent examples with equivalent variations. However, as long as it does not depart from the technical solution of the present invention, any simple modifications, equivalent variations, and changes made to the above examples according to the technical spirit of the present invention still belong to the protection scope of the technical solution of the present invention.

The invention claimed is:

1. An intelligently-connected vehicle LED headlight using graphene, comprising an imaging lens assembly, an LED light source and a heat dissipation assembly, wherein the imaging lens assembly is connected to the LED light source, and the LED light source is connected to the heat dissipation assembly, the heat generated by the LED light source is dissipated by the heat dissipation assembly, and the light of the LED light source is changed by the imaging lens assembly, the imaging lens assembly enables the light emission manner to be a way of horizontally emitting light by imaging, wherein the heat dissipation assembly comprises a super-heat-conducting vapor chamber, a radiator, and a graphene heat-conducting glue, and the LED light source, the graphene heat-conducting glue and the super-heat-conducting vapor chamber are provided inside a housing of the radiator.

2. The intelligently-connected vehicle LED headlight using graphene according to claim 1, wherein the intelligently-connected vehicle LED headlight using graphene has no reflector assembly.

3. The intelligently-connected LED vehicle headlight using graphene according to claim 2, wherein the graphene heat-conducting glue is connected to the super-heat-conducting vapor chamber, and the graphene heat-conducting glue is adhered to the LED light source.

4. The intelligently-connected LED vehicle headlight using graphene according to claim 3, wherein a working liquid in the super-heat-conducting vapor chamber is a graphene phase change composite material.

5. The intelligently-connected LED vehicle headlight using graphene according to claim 2, wherein the graphene heat-conducting glue is connected to the super-heat-conducting vapor chamber, and the graphene heat-conducting glue is adhered to the LED light source.

6. The intelligently-connected LED vehicle headlight using graphene according to claim 2, wherein a working liquid in the super-heat-conducting vapor chamber is a graphene phase change composite material.

7. The intelligently-connected LED vehicle headlight using graphene according to claim 1, wherein the graphene heat-conducting glue is connected to the super-heat-conducting vapor chamber, and the graphene heat-conducting glue is adhered to the LED light source.

8. The intelligently-connected LED vehicle headlight using graphene according to claim 7, wherein a working liquid in the super-heat-conducting vapor chamber is a graphene phase change composite material.

9. The intelligently-connected LED vehicle headlight using graphene according to claim 1, wherein a working liquid in the super-heat-conducting vapor chamber is a graphene phase change composite material.

10. The intelligently-connected LED vehicle headlight using graphene according to claim 1, wherein an outer surface of the radiator is coated with a graphene heat dissipation material.

11. The intelligently-connected LED vehicle headlight using graphene according to claim 1, wherein the imaging lens assembly comprises a fluorescent ceramic, a primary light distribution lens, a light mixer, and a secondary light distribution lens.

12. The intelligently-connected LED vehicle headlight using graphene according to claim 1, wherein a fluorescent ceramic is provided in front of the LED light source, a light mixer is provided closely adjacent to the fluorescent ceramic, and a primary light distribution lens is provided closely adjacent to the light mixer.

* * * * *